US007600744B2

(12) United States Patent
Liou

(10) Patent No.: US 7,600,744 B2
(45) Date of Patent: Oct. 13, 2009

(54) QUICK CLAMPING FIXTURE

(76) Inventor: Ferng Jong Liou, No. 48-1, Cheng Fong Lane, Taiming Rd., Wu Jih, Taichung (TW) 41468

( * ) Notice: Subject to any disclaimer, the term of this patent is extended or adjusted under 35 U.S.C. 154(b) by 0 days.

(21) Appl. No.: 12/007,883

(22) Filed: Jan. 16, 2008

(65) Prior Publication Data

US 2009/0008850 A1 Jan. 8, 2009

(30) Foreign Application Priority Data

Jul. 2, 2007 (TW) ..... 96210712 U

(51) Int. Cl.
*B25B 5/02* (2006.01)
*B25B 5/10* (2006.01)

(52) U.S. Cl. ..... 269/166; 269/3; 269/6

(58) Field of Classification Search ..... 269/166–171.5, 269/147–149, 6, 3
See application file for complete search history.

(56) References Cited

U.S. PATENT DOCUMENTS 836,303 A * 11/1906 Christensen ..... 269/166
1,738,822 A * 12/1929 Odin ..... 269/166
2,415,303 A * 2/1947 Moore ..... 269/166
7,159,859 B2 * 11/2007 Fuller ..... 269/170

* cited by examiner

*Primary Examiner*—Lee D Wilson
(74) *Attorney, Agent, or Firm*—Bacon & Thomas, PLLC

(57) ABSTRACT

A quick clamping fixture includes a main rod, on which two sliders are slidably mounted and may be braked at desired positions to clamp a workpiece between them. The two sliders each have an L-shaped plate and a set of metal plates mounted in a housing thereof with the main rod extended through these plates. The L-shaped plate and the metal plates in the housing are normally pushed by a compression spring into an inclined state to thereby firmly press against an outer surface of the main rod, preventing the slider from sliding along the main rod. When the L-shaped plate is pushed and held, the L-shaped plate and the metal plates are moved into an upright state without firmly pressing against the main rod, allowing the slider to slide along the main rod; and when the L-shaped plate is released, the slider is braked again.

6 Claims, 5 Drawing Sheets

QUICK CLAMPING FIXTURE

FIELD OF THE INVENTION

The present invention relates to a quick clamping fixture, and more particularly to a quick clamping fixture that utilizes a compression spring to push a set of metal plates in a slider into an inclined state for firmly pressing against on a main rod and thereby preventing the slider from sliding along the main rod, and an L-shaped plate to release the metal plates from the inclined state for the slider to slide on the main rod again.

BACKGROUND OF THE INVENTION

There are various types of braking mechanisms being employed on the currently available quick clamping fixtures to stop two sliders thereof from moving when a workpiece has been clamped therebetween. Most of these conventional braking mechanisms can only temporarily hold the sliders in place. In other words, when the sliders or the clamped workpiece is subjected to an external force, the braking mechanism on the sliders will become loosened easily to undesirably release the sliders and accordingly, the workpiece.

Moreover, the two sliders on the conventional quick clamping fixtures could be slid only along and on a main rod and are not removable from the main rod. Therefore, the conventional quick clamping fixture does not provide applications other than clamping a workpiece.

It is therefore tried by the inventor to develop a quick clamping fixture that includes a braking mechanism to provide enhanced braking effect for the sliders, and can be used in different manners to provide other functions.

SUMMARY OF THE INVENTION

To achieve the above and other objects, the quick clamping fixture according to the present invention includes a main rod, on which two sliders are slidably mounted and may be braked at desired positions to clamp a workpiece between them. The two sliders each have a housing, in which an L-shaped plate and a set of metal plates are mounted with the main rod extended through these plates. The L-shaped plate and the set of metal plates in the housing are normally pushed by a compression spring into an inclined state to thereby firmly press against an outer surface of the main rod, preventing the slider from sliding along the main rod. When the L-shaped plate is pushed and held, the L-shaped plate and the set of metal plates are moved into an upright state without firmly pressing against the main rod, allowing the slider to slide along the main rod; and when the L-shaped plate is released, the slider is braked again.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
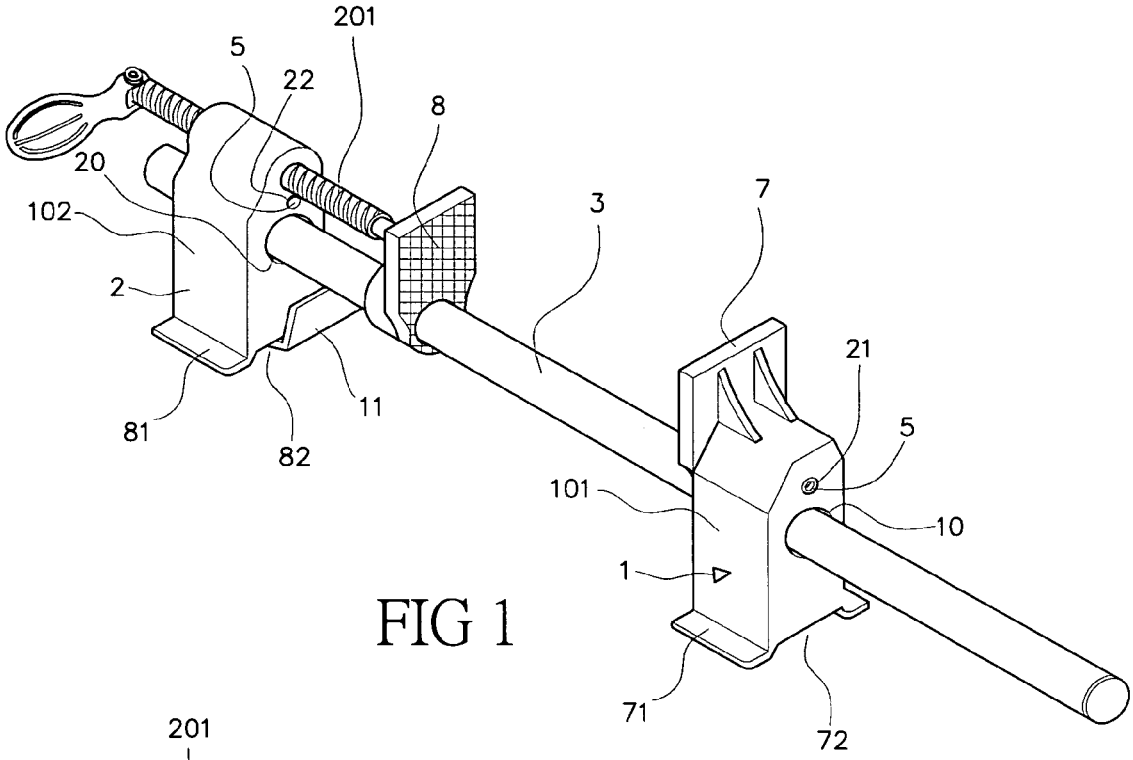
FIG. 1 is an assembled perspective view of a quick clamping fixture according to the present invention.
Figure 2:
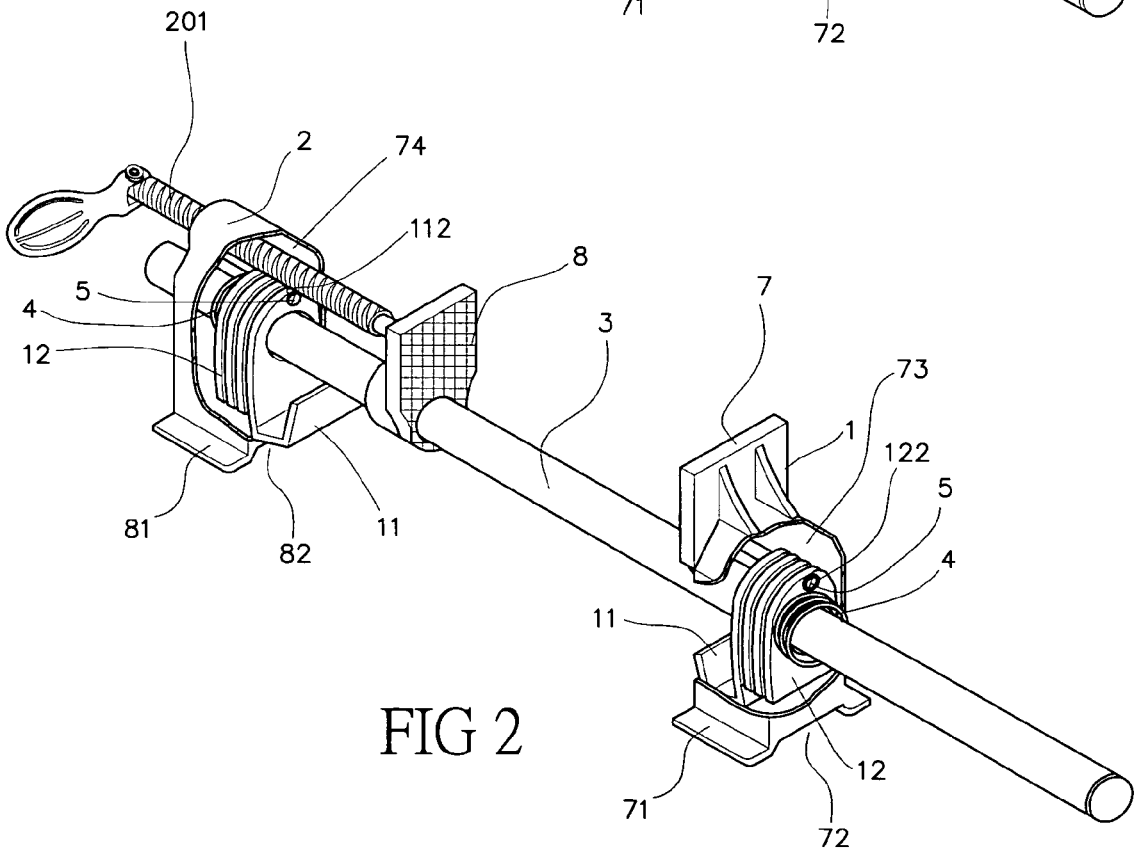
FIG. 2 is a cutaway view of FIG. 1.

Please refer to FIGS. 1 and 2, in which a quick clamping fixture according to the present invention is shown. The quick clamping fixture of the present invention includes a slider 1, a fine-adjustment slider 2, a main rod 3, two L-shaped plates 11 having a large and a small bore 111, 112 each, two compression springs 4, two bolts 5, two collars 6, and two sets of metal plates 12 having a large and a small bore 121, 122 each.

The slider 1 includes a housing 101 defining an internal space 73; a first jaw 7 provided on the housing 101 at an upper front end thereof; and a base 71 provided at a bottom of the housing 101 to define a lower space 72 between the bottom of the housing 101 and the base 71. The housing 101 is provided on front and rear walls at a center thereof with two corresponding openings 10, and on the front and rear walls near an upper end thereof with two corresponding screw holes 21.

A first one of the two L-shaped plates 11, a first one of the two sets of metal plates 12, and a first one of the two compression springs 4 are sequentially mounted in the internal space 73 of the housing 101 of the slider 1 from front to rear, with a lower horizontal portion of the first L-shaped plate 11 forward extended through the lower space 72 to locate outside the housing 101.

The slider 1 is assembled to the main rod 3 by extending the main rod 3 through the two corresponding openings 10 on the housing 101, the large bore 111 on the first L-shaped plate 11, the large bores 121 on the first set of metal plates 12, and the first compression spring 4. A first one of the two bolts 5 is extended through the two corresponding screw holes 21 on the housing 101, the small bore 112 on the first L-shaped plate 11, and the small bores 122 on the first set of metal plates 12, and fixed at two ends to the front and rear walls of the housing 101. A first one of the two collars 6 is mounted on the first bolt 5 to locate between the front wall of the housing 101 and the first L-shaped plate 11.

Figure 3:
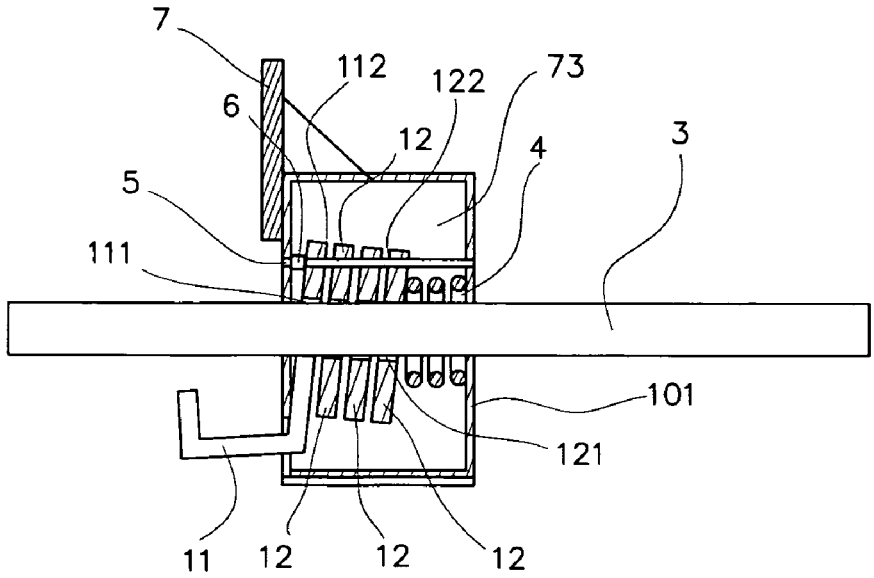
FIG. 3 is a fragmentary sectioned side view showing a slider of the present invention is in a braked state.

With the above arrangements, the first compression spring 4 mounted on the main rod 3 and located between the rear wall of the housing 101 and the first set of metal plates 12 is able to normally forward push the first L-shaped plate 11 and the first set of metal plates 12 into a rearward inclined state on the main rod 3, as shown in FIG. 3, such that the rearward inclined first L-shaped plate 11 and first set of metal plates 12 in the housing 101 are firmly pressed at the large bore 111 and the large bores 121, respectively, against an outer surface of the main rod 3, bringing the slider 1 into a braked state.

The fine-adjustment slider 2 includes a housing 102 defining an internal space 74; a hand-operable screw rod 201 axially extended through near an upper end of the housing 102; a second jaw 8 connected near an upper end to a front end of the screw rod 201 with the main rod 3 extended through near a lower end of the second jaw 8; and a base 81 provided at a bottom of the housing 102 to define a lower space 82 between the bottom of the housing 102 and the base 81. The housing 102 is provided on front and rear walls at a center thereof with two corresponding openings 20, and on the front and rear walls near an upper end thereof with two corresponding screw holes 22.

A second one of the two L-shaped plates 11, a second one of the two sets of metal plates 12, and a second one of the two compression springs 4 are sequentially mounted in the internal space 74 of the housing 102 of the fine-adjustment slider 2 from front to rear, with a lower horizontal portion of the second L-shaped plate 11 forward extended through the lower space 82 to locate outside the housing 102. The fine-adjustment slider 2 is assembled to the main rod 3 by extending the main rod 3 through the two corresponding openings 20 on the housing 102, the large bore 111 on the second L-shaped plate 11, the large bores 121 on the second set of metal plates 12, and the second compression spring 4. A second one of the two bolts 5 is extended through the two corresponding screw holes 22 on the housing 102, the small bore 112 on the second L-shaped plate 11, and the small bores 122 on the second set of metal plates 12, and fixed at two ends to the front and rear walls of the housing 102. A second one of the two collars 6 is mounted on the second bolt 5 to locate between the front wall of the housing 102 and the second L-shaped plate 11.

With the above arrangements, the second compression spring 4 mounted on the main rod 3 and located between the rear wall of the housing 102 and the second set of metal plates 12 is able to normally forward push the second L-shaped plate 11 and the second set of metal plates 12 into a rearward inclined state on the main rod 3, similar to that shown in FIG. 3, such that the rearward inclined second L-shaped plate 11 and second set of metal plates 12 in the housing 102 are firmly pressed at the large bore 111 and the large bores 121, respectively, against an outer surface of the main rod 3, bringing the fine-adjustment slider 2 into a braked state.

By mounting the two L-shaped plates 11 and the two sets of metal plates 12 in the housings 101, 102 in the above manner, the L-shaped plates 11 and the metal plates 12 may be moved along with the housings 101, 102 on the main rod 3 to and fro.

And, by manually rotating the screw rod 201 forward, the second jaw 8 connected to the front end of the screw rod 201 is brought to gradually move along the main rod 3 toward or away from the first jaw 7, so as to finely adjust a distance between the first and the second jaw 7, 8 for firmly and safely clamping a workpiece between the two jaws 7, 8.

Figure 4:
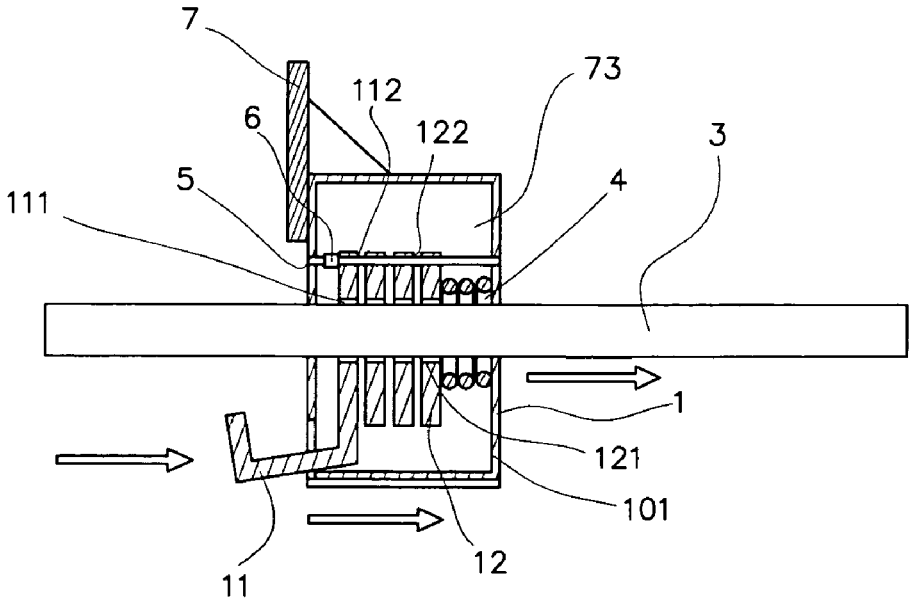
FIG. 4 is a fragmentary sectioned side view showing the slider of the present invention is in a movable state.

Please refer to FIG. 4. When it is desired to move the slider 1 or the fine-adjustment slider 2 along the main rod 3, simply push and hold the horizontal lower portion of the L-shaped plate 11 located outside the housing 101, 102. At this point, the L-shaped plate 11 and the sets of metal plates 12 are together moved into an upright position on the main rod 3 in the housing 101, 102, and the compression spring 4 is compressed, such that the L-shaped plate 11 and the set of metal plates 12 no longer firmly press at the large bores 111, 121 against the outer surface of the main rod 3. That is, the slider 1 or the fine-adjustment slider 2 is released from the braked state and may be slid along the main rod 3 to a desired position.

When the slider 1 or the fine-adjustment slider 2 has been moved along the main rod 3 to the desired position to firmly clamp a workpiece between the first and the second jaw 7, 8, and it is desired to brake the slider 1 or the fine-adjustment slider 2 on the main rod 3, an operator needs only to release the L-shaped plate 11. At this point, an elastic restoring force of the compressed compression spring 4 automatically pushes the L-shaped plate 11 and the set of metal plates 12 into the rearward inclined state on the main rod 3, so that the L-shaped plate 11 and the set of metal plates 12 are firmly pressed at the large bores 111, 121 against the main rod 3 again, and the slider 1 or the fine-adjustment slider 2 is braked.

Figure 5:
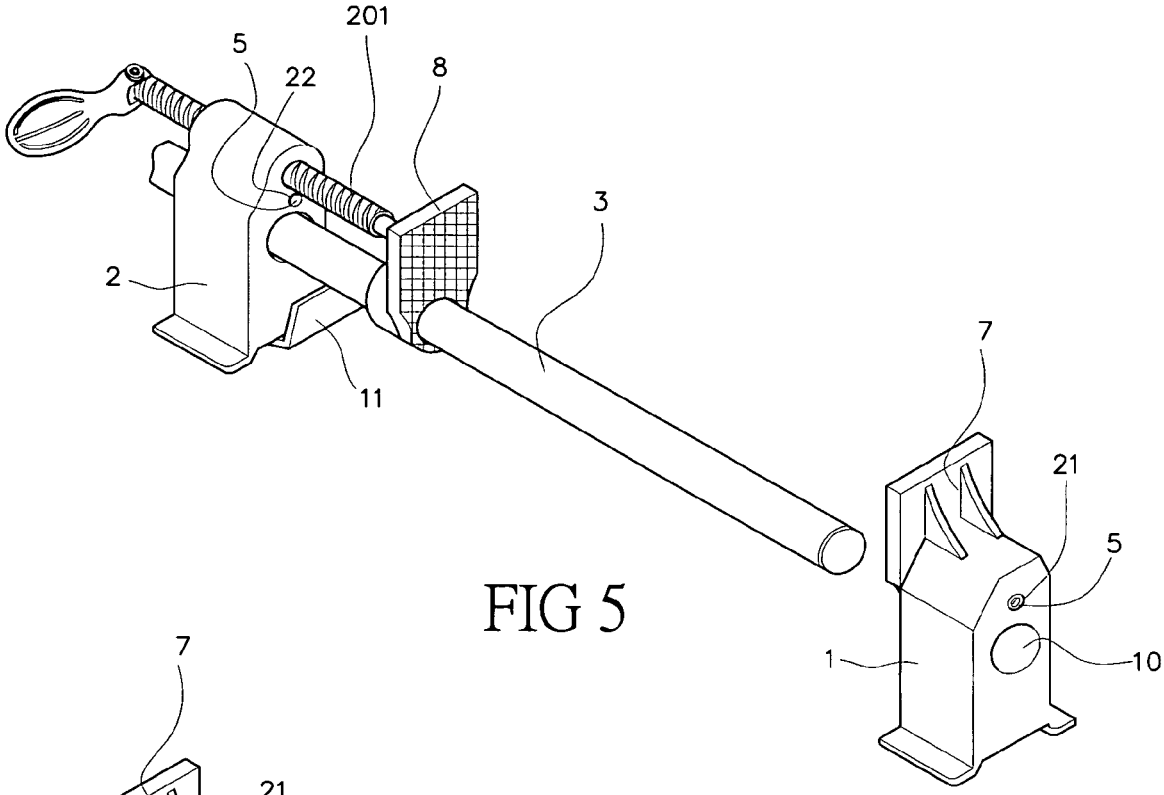
FIG. 5 shows the slider is removed from a main rod of the present invention via an end thereof.
Figure 6:
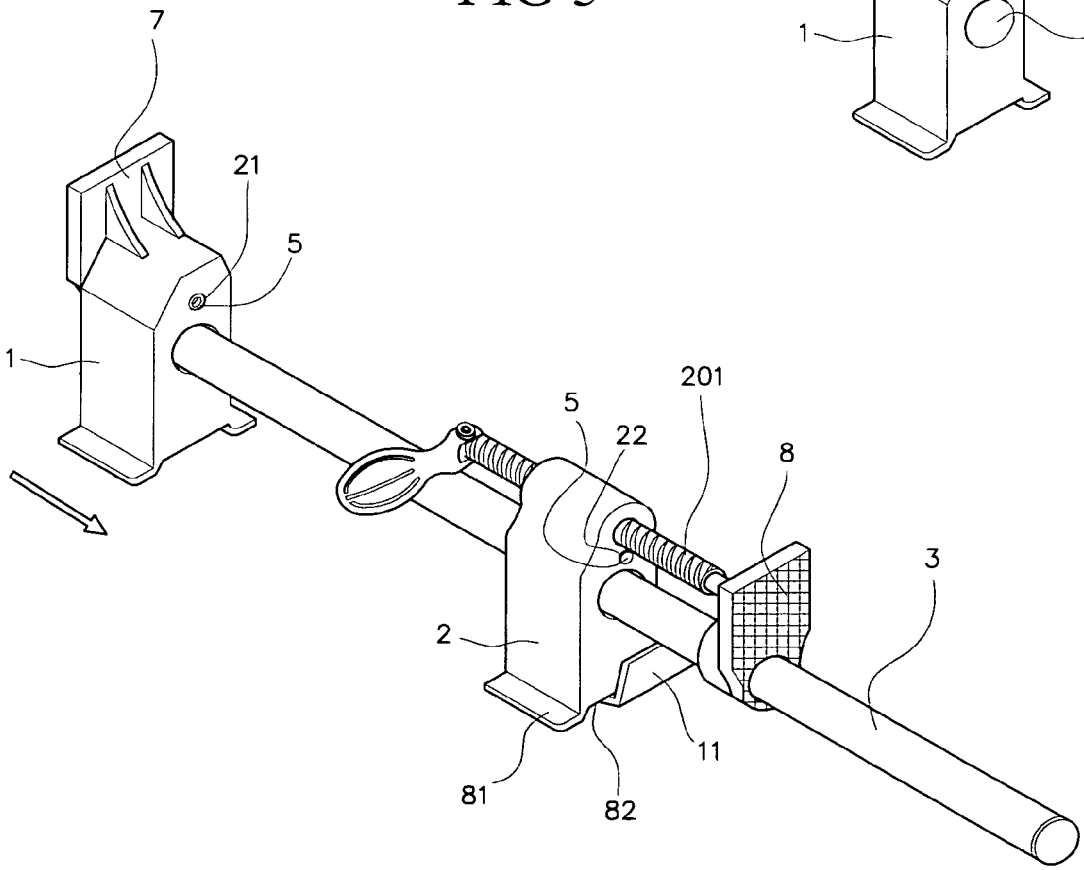
FIGS. 6, 7, and 8 show the slider removed from the main rod is re-mounted to the main rod via another end of the main rod.
Figure 7:
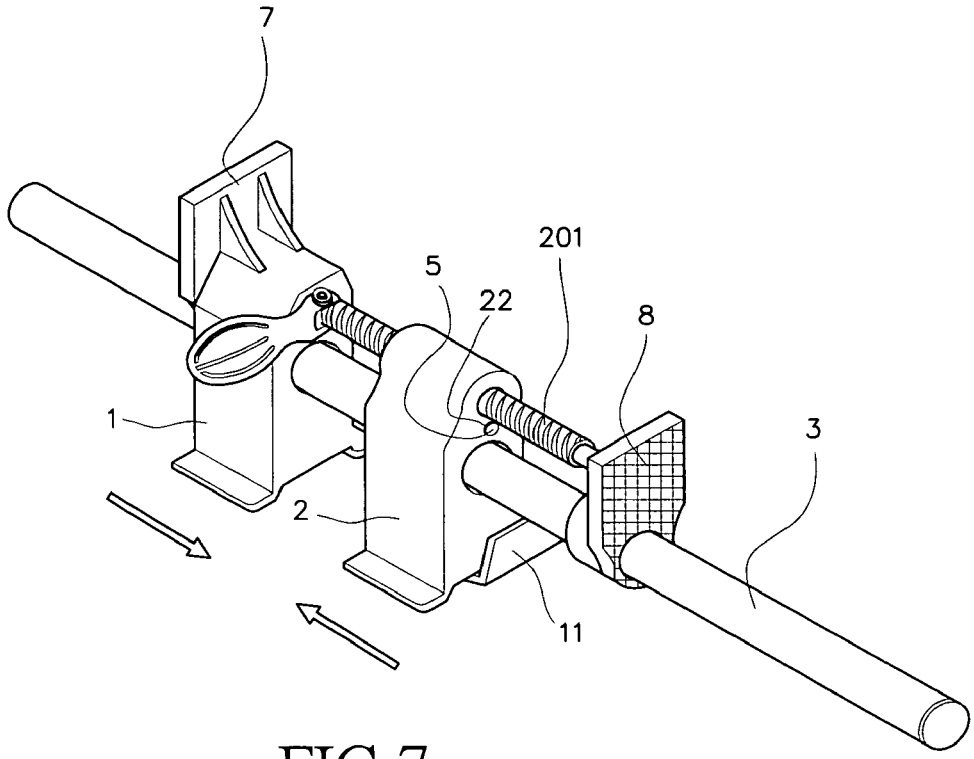
Figure 8:
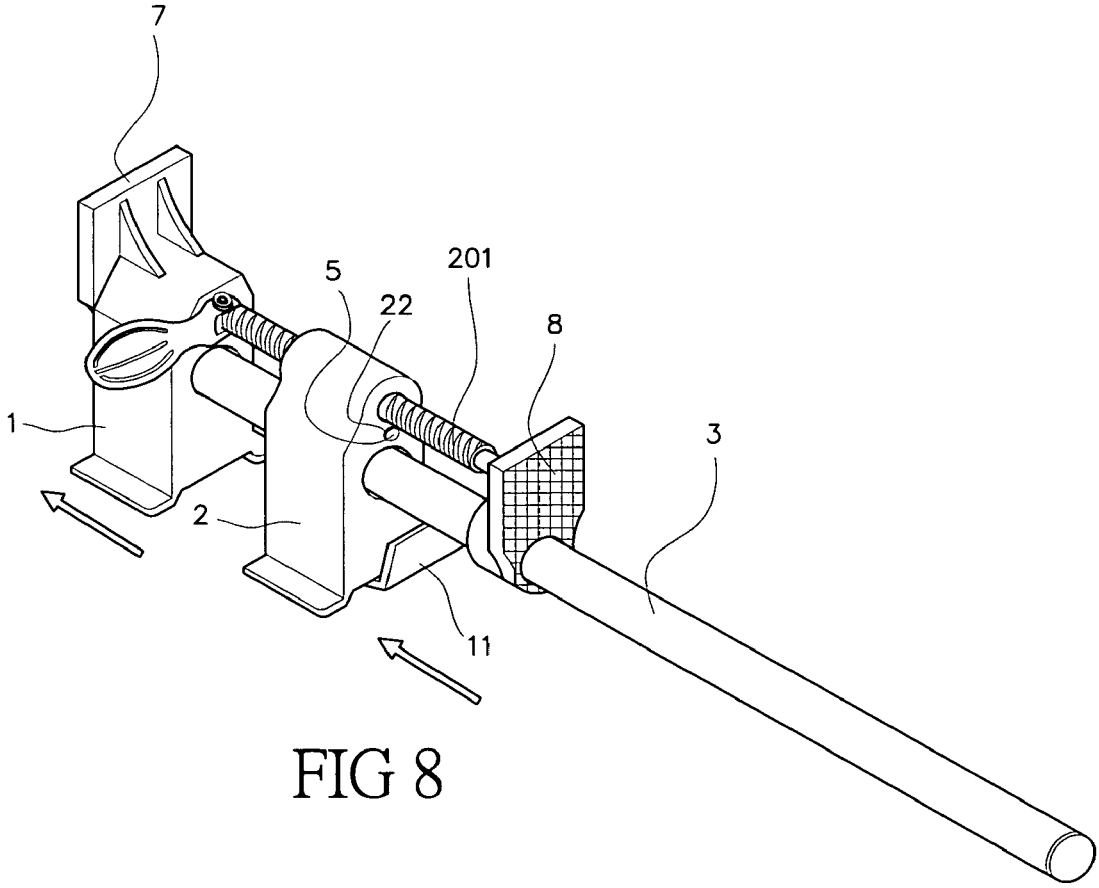

Please refer to FIG. 5. Both of the slider 1 and the fine-adjustment slider 2 may be removed from the main rod 3 via an end thereof. FIGS. 6, 7, and 8 show the slider 1 is removed from the main rod 3 via a first end thereof and then remounted to the main rod 3 via a second end thereof, so that the first and the second jaw 7, 8 are facing away from each other. With the two jaws 7, 8 facing away from each other, the quick clamping fixture of the present invention may be used to expand a workpiece.

Figure 9:
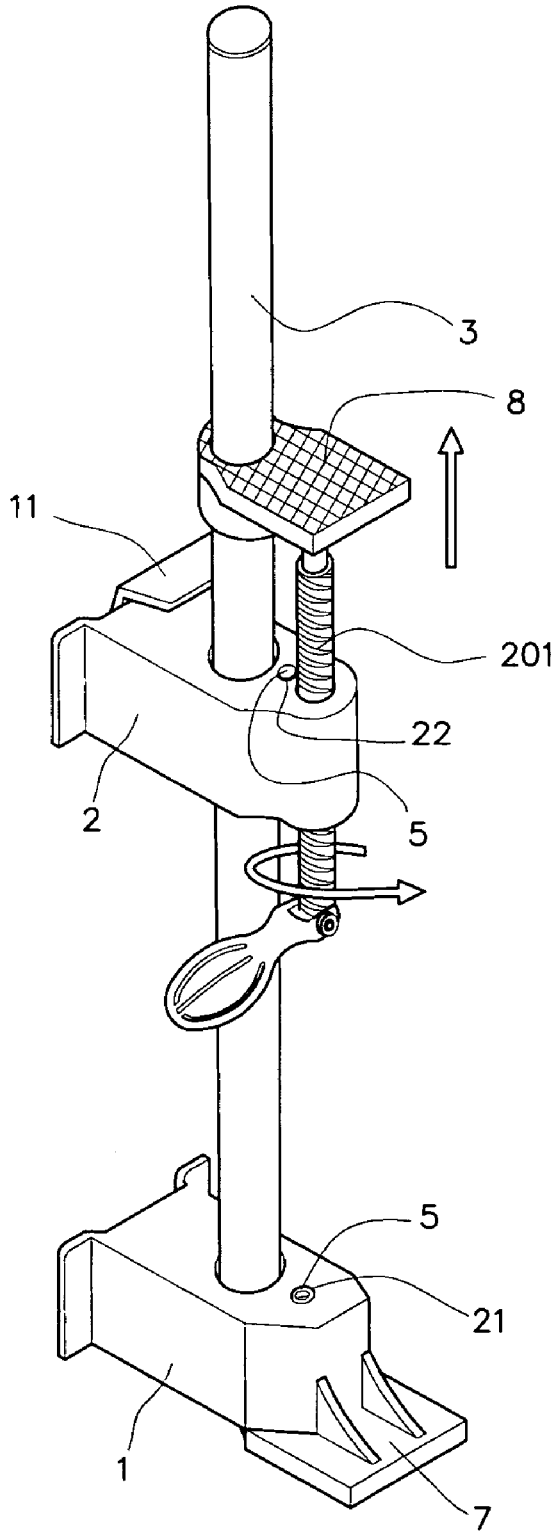
FIG. 9 shows the quick clamping fixture of the present invention is used as a jack lift.

Please refer to FIG. 9. When the quick clamping fixture of the present invention with the two jaws 7, 8 facing away from each other is disposed in an upright position, the quick clamping fixture may be conveniently used as a jack lift.

Since the metal plates 12 are closely arranged in the housings 101, 102 to thereby produce a considerably large overall thickness for each set of the metal plates 12, when the metal plates 12 are rearward inclined in the housing 101, 102, all the large bores 121 on the inclined metal plates 12 are firmly pressed against the main rod 3 at the same time to produce an increased total contact area between the large bores 121 and the outer surface of the main rod 3, so that the slider 1 and the fine-adjustment slider 2 in the braked state are not subject to any risk of loosening from the main rod 3 easily.

What is claimed is:

1. A quick clamping fixture, comprising:

a slider including a first housing, a first jaw disposed on the first housing at an upper front end portion thereof, and a base disposed at a bottom portion of the first housing;

a fine-adjustment slider including a second housing, a hand-operable screw rod axially extending through an upper end portion of the second housing, a second jaw coupled to a front end portion of the screw rod, a main rod extending through a lower end portion of the second jaw, and a base disposed at a bottom portion of the second housing;

first and second L-shaped plates respectively disposed at predetermined positions in the first and second housings, wherein each L-shaped plate has a large bore formed therein and a small bore formed therein above the large bore;

first and second sets of metal plates respectively disposed at predetermined positions in the first and second housings, wherein each set of metal plates has a large bore formed therein and a small bore formed therein above the large bore, and the large bore and the small bore of each set of metal plates respectively correspond to the large bore and the small bore in a respective L-shaped plate;

first and second compression springs respectively disposed in the first and second housings adjacent a respective one of the first and second sets of metal plates;

first and second bolts respectively extending through the small bores of both one of the first and second L-shaped plates and one of the first and second sets of metal plates; and first and second collars respectively disposed on the first and second bolts.

2. The quick clamping fixture as claimed in claim 1, wherein the base of the slider and the base of the fine-adjustment slider are configured to respectively define a lower space between the bottom portions of the slider and the fine-adjustment slider and the bases of the slider and the fine-adjustment slider.

3. The quick clamping fixture as claimed in claim 2, wherein the L-shaped plates each have a lower horizontal portion extending forwardly through the lower space to a position outside the slider and the fine-adjustment slider.

4. The quick clamping fixture as claimed in claim 1, wherein the first and second housings respectively define an internal space therein and each correspondingly have formed in a front wall and a rear wall thereof at predetermined positions an opening and a screw hole above the opening, the main rod extending through the opening in the first and second housings, and the first and second bolts respectively extending through the screw holes of the first and second housings.

5. The quick clamping fixture as claimed in claim 4, wherein the slider and the fine-adjustment slider respectively have one of the first and second L-shaped plates, one of the first and second sets of metal plates, and one of the first and second compression springs mounted in the internal space of a respective one of the first and second housings from front to rear, wherein the main rod and one of the first and second bolts extend through a respective L-shaped plate, a respective set of metal plates, and a respective compression spring, and wherein a respective collar is located between the respective L-shaped plate and the front wall of the respective housing, the respective compression spring is mounted on the main rod between the respective set of metal plates and the rear wall of the respective housing such that the respective compression spring pushes the respective L-shaped plate and the respective set of metal plates into a rearward inclined state to thereby firmly press an inside surface of the large bores of the respective L-shaped plate and the respective set of metal plates against an outer surface of the main rod.

6. The quick clamping fixture as claimed in claim 5, wherein the main rod extends through the first and second L-shaped plates and the first and second sets of metal plates via the large bores in the L-shaped plates and the first and second sets of metal plates.

* * * * *